US007028874B2

(12) United States Patent
Lin

(10) Patent No.: US 7,028,874 B2
(45) Date of Patent: Apr. 18, 2006

(54) WINDOWS-BREAKING EMERGENCY ESCAPE DEVICE

(75) Inventor: Ming-Cheng Lin, Taipei (TW)

(73) Assignee: Clear Dawn Co., Ltd., Taipei (TW)

( * ) Notice: Subject to any disclaimer, the term of this patent is extended or adjusted under 35 U.S.C. 154(b) by 53 days.

(21) Appl. No.: 10/726,661

(22) Filed: Dec. 4, 2003

(65) Prior Publication Data

US 2005/0120563 A1 Jun. 9, 2005

(51) Int. Cl.
*B26F 3/00* (2006.01)

(52) U.S. Cl. ..... 225/93; 30/367; 173/202; 7/144

(58) Field of Classification Search ..... 173/202–203; 30/123, 277, 366–367; 81/20, 463, DIG. 12; 7/100, 137, 143, 144, 165; 362/109, 119; 340/438, 321; 225/93; 116/3, 4, 202, 147; D8/81, 105

See application file for complete search history.

(56) References Cited

U.S. PATENT DOCUMENTS

| | | | | |
|---|---|---|---|---|
| 3,900,058 | A * | 8/1975 | McArdle | 81/463 |
| 5,097,913 | A * | 3/1992 | Lennart Gustafsson | 173/210 |
| 5,657,543 | A * | 8/1997 | Collins | 30/367 |
| 5,952,916 | A * | 9/1999 | Yamabe | 340/468 |
| 6,574,816 | B1 * | 6/2003 | Yu Chen | 7/100 |
| 6,666,566 | B1 * | 12/2003 | Uke | 362/202 |
| 6,766,933 | B1 * | 7/2004 | Wang | 225/93 |
| 6,816,064 | B1 * | 11/2004 | Ruiz | 340/321 |

* cited by examiner

*Primary Examiner*—Allan N. Shoap
*Assistant Examiner*—Carolyn Blake
(74) *Attorney, Agent, or Firm*—Troxell Law Office, PLLC

(57) ABSTRACT

A windows-breaking emergency escape device including a main body, a hammer and a supplementary power apparatus, wherein the hammer and the supplementary power apparatus are installed on the main body. The front end of the hammer extrudes from the surface of the main body. The supplementary power apparatus will reserve enough power in advance to lessen an operating force and to release the reserved power to drive the hammer to break the car window when a car accident happened. Moreover, the main body of the device of the present invention includes a groove containing a cutter.

11 Claims, 6 Drawing Sheets

WINDOWS-BREAKING EMERGENCY ESCAPE DEVICE

BACKGROUND OF THE INVENTION (a). Field of the Invention

The invention is related to a windows-breaking emergency escape device, more specifically, to a windows-breaking emergency escape device that has a supplementary power apparatus and a safety cutter.

(b). Description of the Prior Arts

Conventionally, safety device installed in a car for protecting passengers from being injured in an emergency situation include air bag, ABS and TCS etc. However, another device draw more and more attention in such safety issue recently, which is the windows-breaking emergency escape device. A windows-breaking emergency escape device is considered to be used in a emergency situation, such as a car falling into water or a car caught in the fire. In such situations, the passengers in the car need to break the car windows immediately to escape from the car in a short and critical time.

According to statistics, many people are killed in car accidents, such as when the car falls into water or is caught in a fire. In such situations, it is very difficult for passengers in the car to escape from the car in a very short time, and eventually the passengers are killed. Therefore, the windows-breaking emergency escape device provides an excellent option to keep people from being killed in an emergency situation with a cost-saving and effective solution.

Now referring to FIG. 1, which is showing a conventional windows-breaking emergency escape device. As shown, the conventional windows-breaking emergency escape device comprises a main body A made of metal material, the main body A includes a handler B for user to hold the device, the front end of the main body A has a cone-shaped hammer head C and a cutter D. When the accident happened, the user can hold the main body A of the device with the handler B and hit the car window with cone-shaped hammer head C to break the car windows to escape from the car, and the cutter is used to cut off the seat belt when the user can not unfasten the seat belt in time.

Although the conventional windows-breaking emergency escape device described above can be used to break car windows during the emergency, there is still much room in aspect of its structure for improvement. First, for convenience, most of time the conventional windows-breaking emergency escape device is installed on the left hand side of the driver's seat, so, when the emergency happened, the driver will use his left hand to grab the device and use it to break the left hand window of the car. However, in nature, the left hand of human is weaker and the operation of left hand to break the left hand window is awkward. And, for nowadays, more and more car drivers are female, the situation is even worse when the driver is female. Another problem is the cutter attached on the device, it is easy to hurt the user when using it during such emergency.

In order to overcome the drawbacks described above, the windows-breaking emergency escape device of the present invention is provided, which not only much improves the drawbacks of a conventional windows-breaking emergency escape device but also provide many other advantages.

SUMMARY OF THE INVENTION

The first objective of the present invention is to provide a windows-breaking emergency escape device that has a main body, a hammer and a supplementary power apparatus, wherein the hammer and the supplementary power apparatus are installed on the main body, the user can either hold the main body to break the car window with the hammer by user himself or utilize the power supplying by the supplementary power apparatus to drive the hammer to break the car window.

The second objective of the present invention is to provide a windows-breaking emergency escape device that has a groove disposed on the main body of the device, the width of the groove is smaller than that of a child's finger, which can hold the cutter in a safe manner and prevent the user being wounded due to carelessness.

The third objective of the present invention is to provide a windows-breaking emergency escape device that has an emergency lighting apparatus that can provide lighting and positioning function in an emergency situation.

BRIEF DESCRIPTION OF THE DRAWINGS

The objects, spirits and advantages of the preferred embodiments of the present invention will be readily understood by the accompanying drawings and detailed descriptions, wherein.

DETAILED DESCRIPTION OF THE PRESENT INVENTION

Hereinafter, several preferred will be used to depict the detailed structures, motion patterns, efficiency and other characteristics of the present invention.

Figure 1:
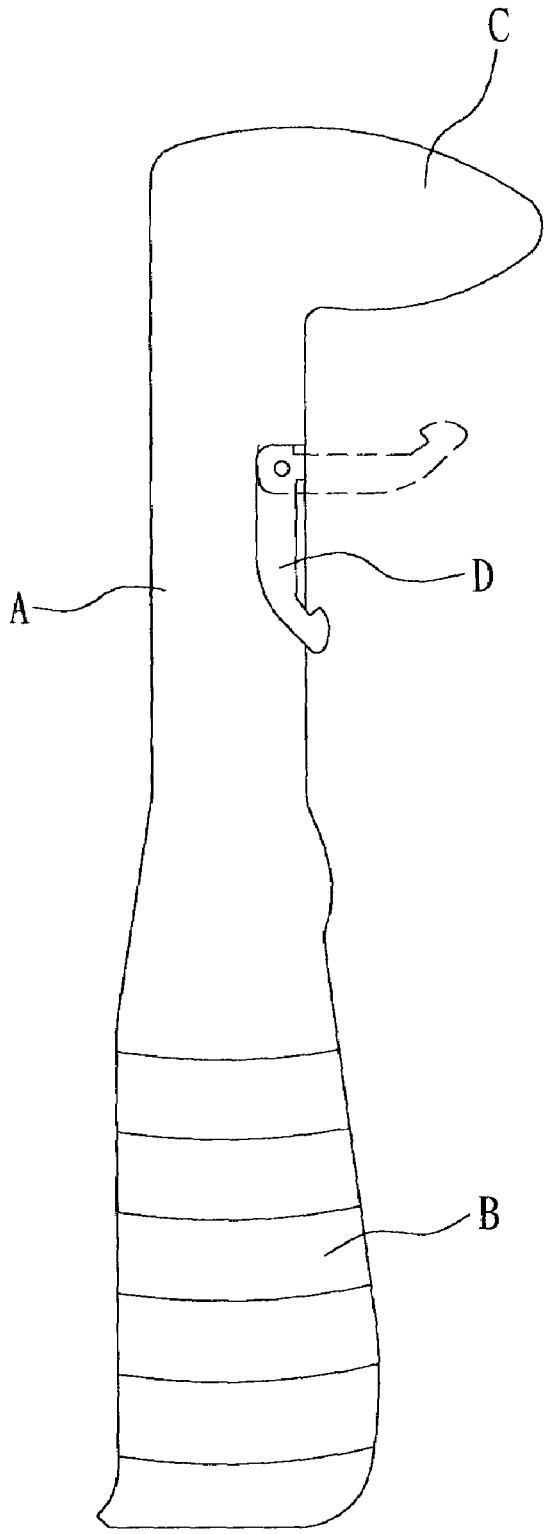
F I G. 1 (PRIOR ART)
FIG. 1 is a diagram showing a conventional windows-breaking emergency escape device.
Figure 2:
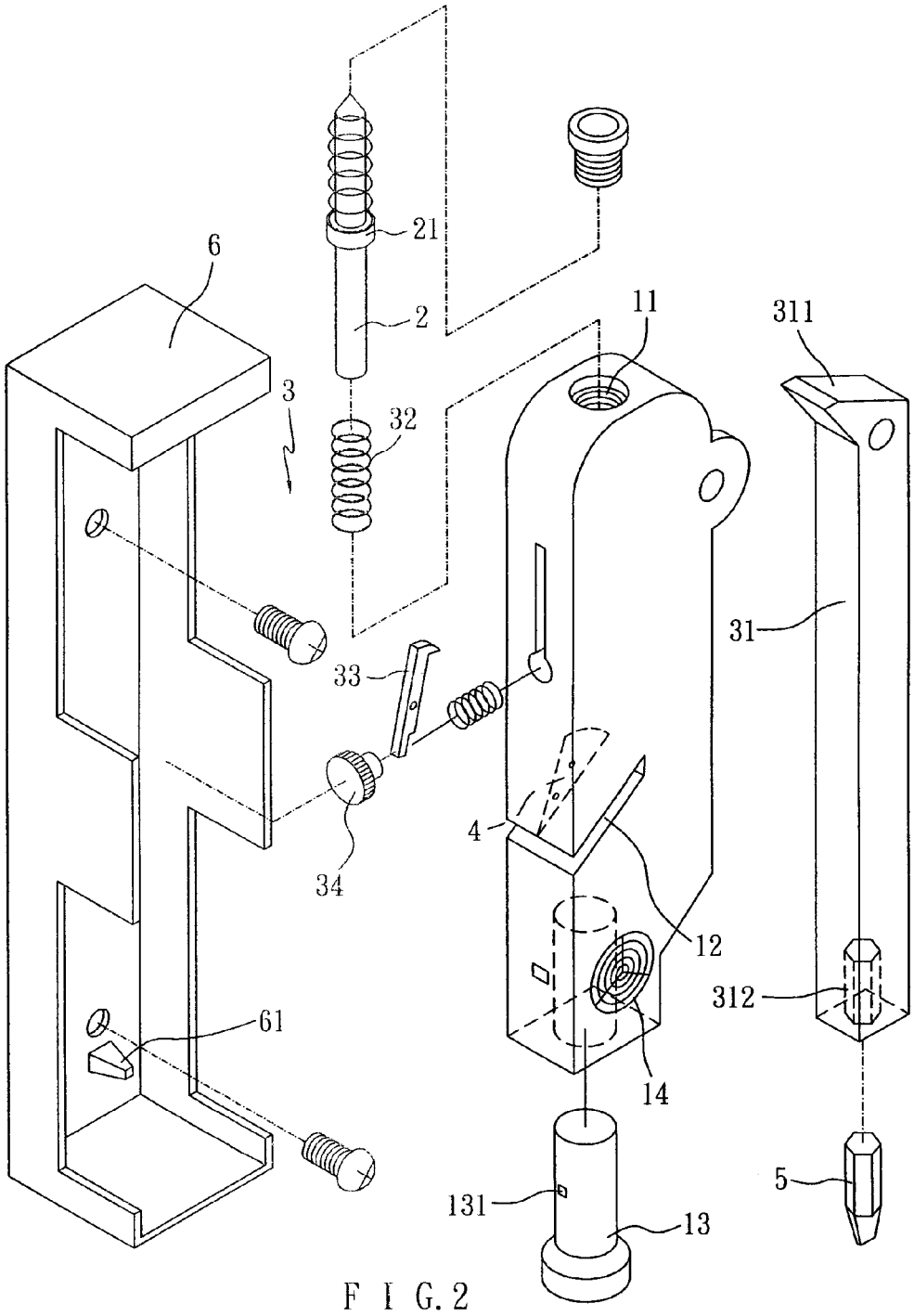
FIG. 2 is a diagram of the perspective-disassembled view of the windows-breaking emergency escape device of the present invention.
Figure 3:
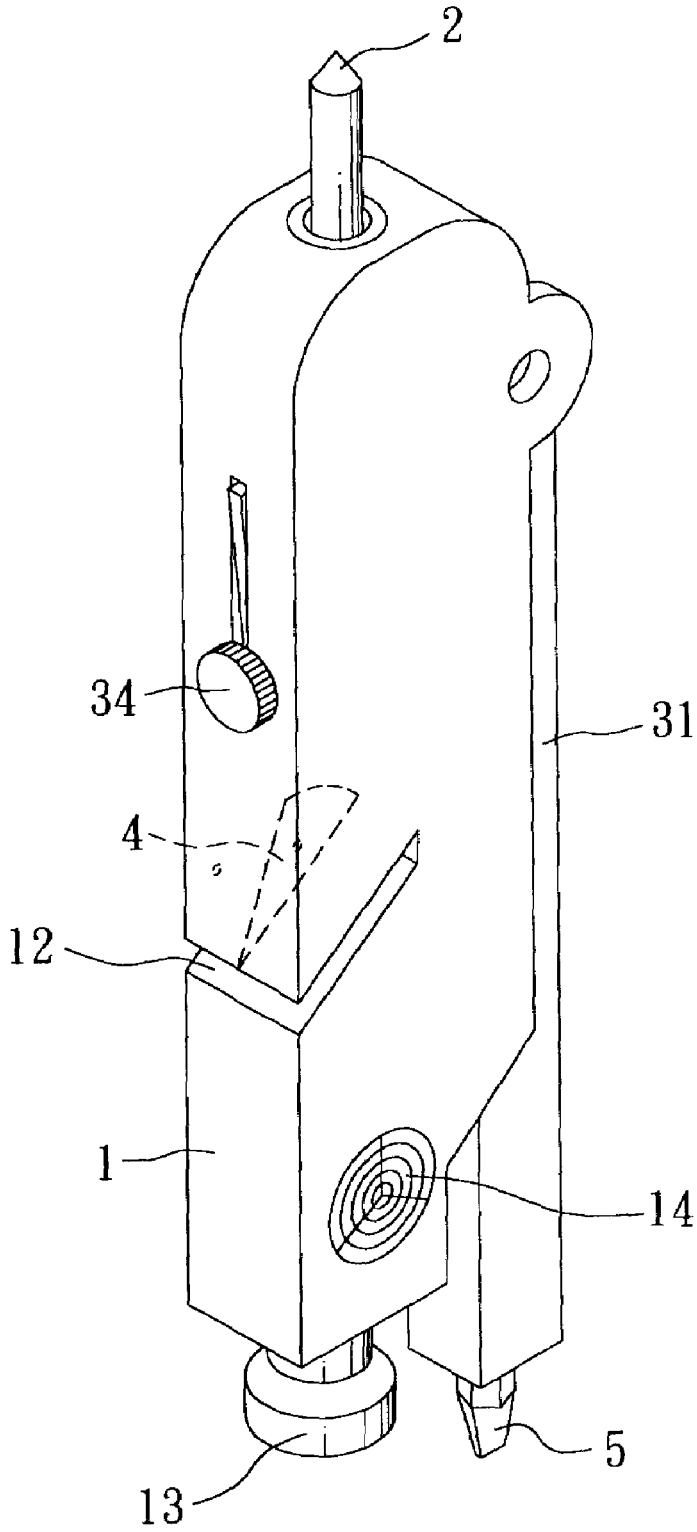
FIG. 3 is a diagram of the perspective-assembled view of the windows-breaking emergency escape device of the present invention.
Figure 4:
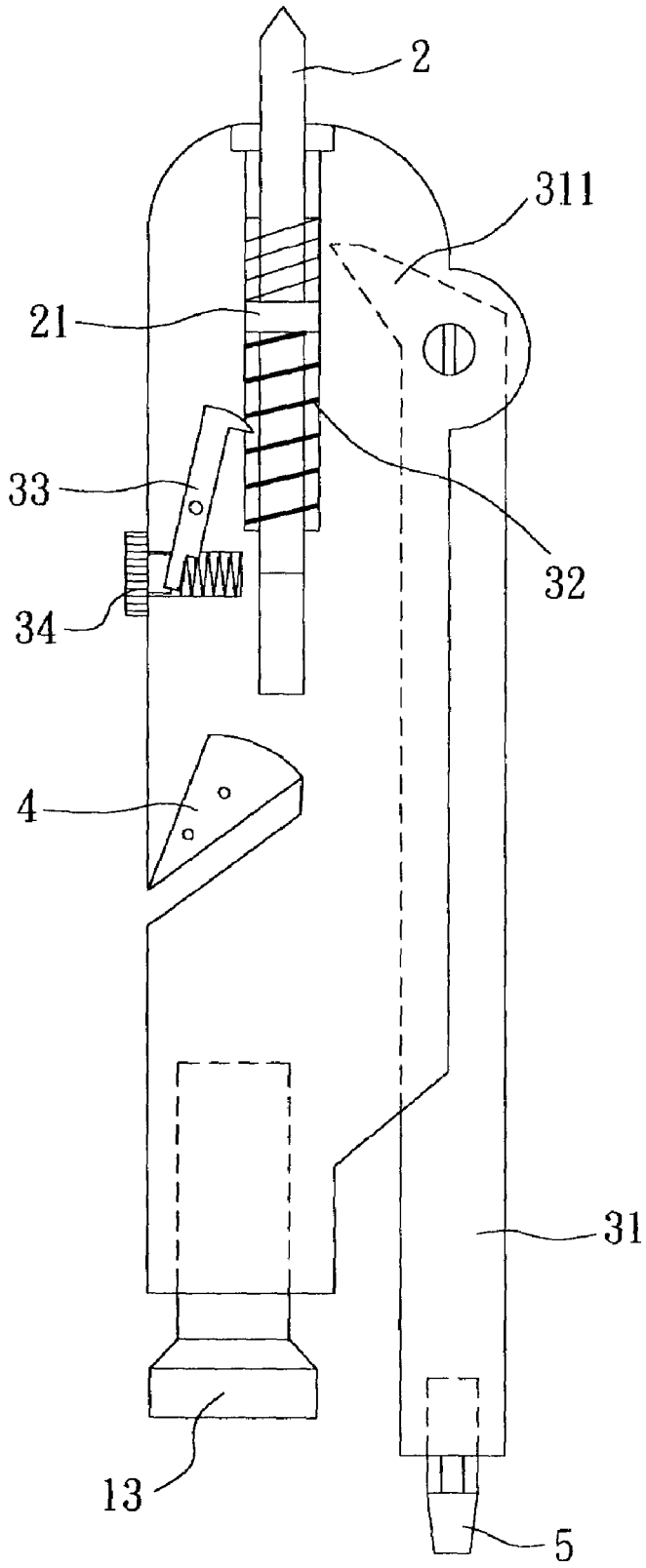
FIG. 4 is a diagram of the sectional view of the windows-breaking emergency escape device of the present invention.

Please referring to FIG. 2, FIG. 3 and FIG. 4, which are diagrams of the perspective-disassembled view, perspective-assembled view and sectional view of the windows-breaking emergency escape device of the present invention. As seen in these diagrams, the windows-breaking emergency escape device of the present invention comprises a main body 1, a hammer 2 and a supplementary power apparatus 3, wherein the hammer 2 and the supplementary power apparatus 3 are installed on the main body 1, the front end of the hammer 2 extrudes from the surface of the main body 1, the improvement comprising that the supplementary power apparatus 3 further comprises a handler 31, a elastic component 32, a buckling component 33 and a release button 34, wherein a groove 11 is disposed on the main body 1 for receiving the hammer, the elastic component 33 is disposed between the hammer 2 and the groove 11 for providing a force to push the hammer outward. A circle rim 21 is disposed on the hammer 2, and the handler 31 is pivoted on the main body 1. One end of the handler 31 extends to form an extruding portion 311 that contacts against the rim 21 on the hammer 2. The handler 31 is disposed near the extruding portion 311, and when the user is moving the handler 31, the hammer 2 will be pushed inward to press the elastic component 3. The buckling component 33 is pivoted and fixed firmly on the main body 1, one end of the buckling component 33 contacts against the release button 34, another end of the buckling component 33 extrudes and extends into the groove 11 that is containing the hammer 2. When the hammer 2 is pushed by the extruding portion 311 of the handler 31 to move backward and to push the elastic components 32 to a certain position, the hammer 2 will be hold by the buckling component 33, and the device enters into a strength-reserved stage (as shown in FIG. 5A).

Figure 5A:
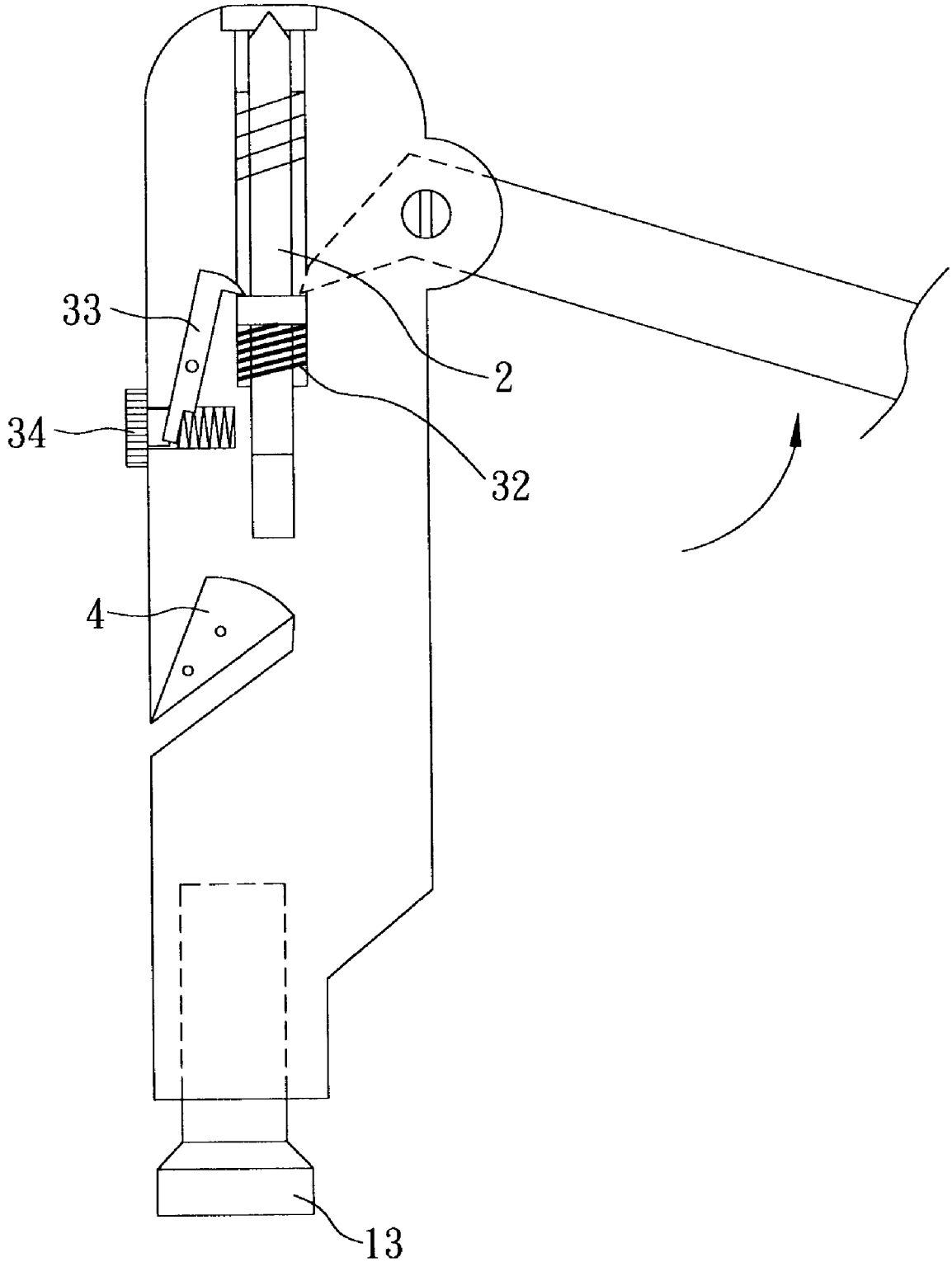
FIG. 5A is a diagram of the sectional view of the windows-breaking emergency escape device of the present invention when the supplementary strength is reserved.
Figure 5B:
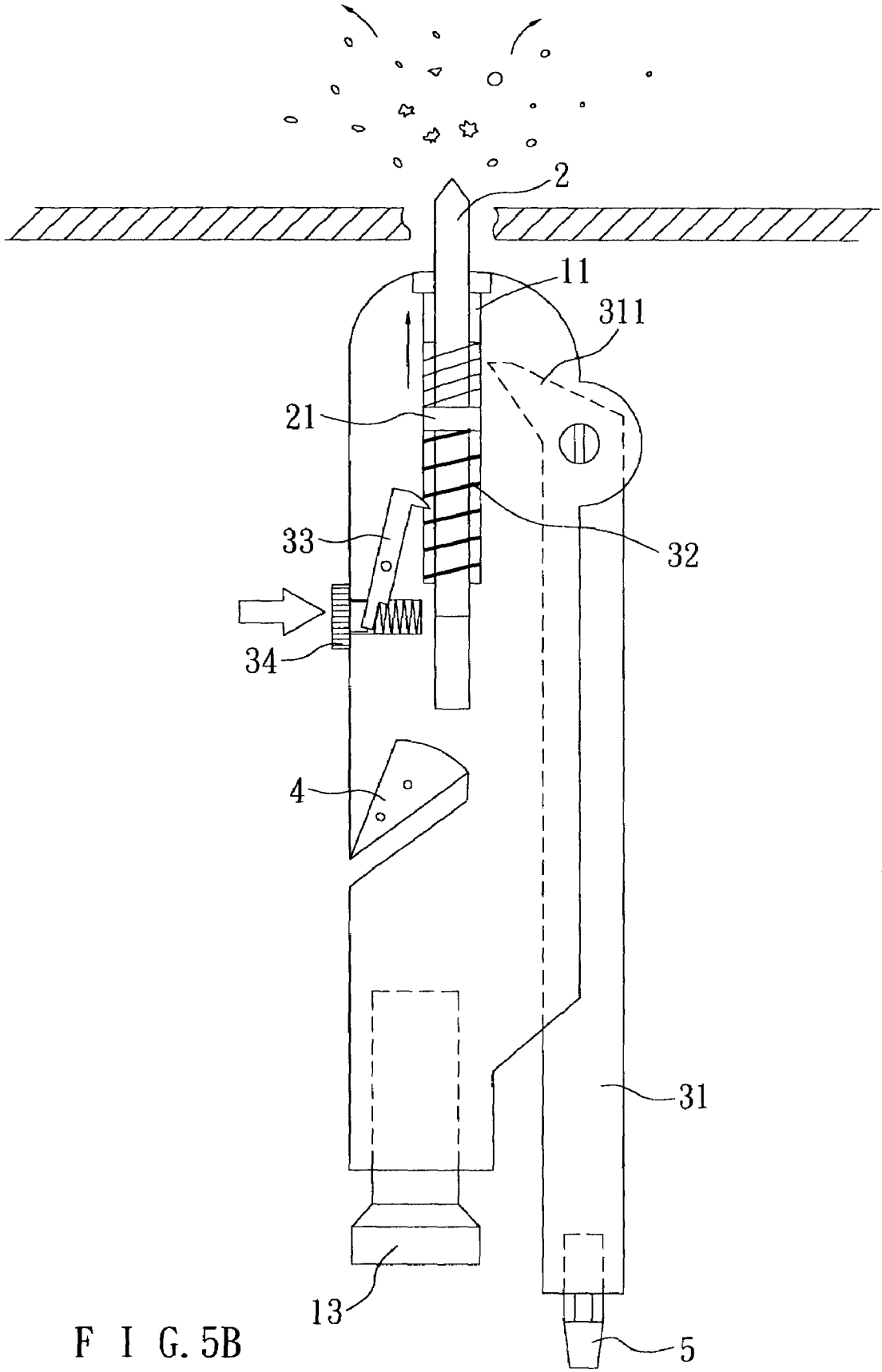
FIG. 5B is a diagram of the sectional view of the windows-breaking emergency escape device of the present invention when the supplementary strength is released.

Please referring the FIGS. 5A and 5B mow, which are showing two different stages of the device of the present invention. As described before, when an accident happened, if the user is a male, he can just hold the device of the present invention to break the car window. However, if the user is a female, she can pull the handler 31 first to move the extruding portion 311 of the handler 31 to push the hammer 2 inward to push against the elastic component 32. When the hammer 2 reaches to a certain position, the buckling component 33 will hold the hammer 2, and because of the elastic component 32, a strength moving the hammer 2 outward is reserved (as shown in FIG. 5A). The user then can aim the device of the present invention to the car window at proper place, and push the release button 34 to release the strength reserved by the elastic component 32 on the hammer 2, the hammer 2 will be released and project extremely fast to hit and break the car window.

Furthermore, a cutter groove 12 is disposed on the main body 1 and a cutter 4 is installed inside the cutter groove 12, the cutter will cut down an object being put inside the cutter groove 12 properly. The width of the groove is smaller than that of a child's finger, so the groove is small enough to prevent the user from being wounded due to careless. The user can use the cutter 4 to cut the belt when an accident happened and in a critical situation the user is not able to unfasten the safety belt properly.

In addition, a lighting apparatus 13 is disposed on the main body 1 for providing the lighting and positioning function in an emergency situation. With proper design, the lighting apparatus 13 can flash the light in a certain pattern, such as a SOS mode.

Moreover, a hole 312 is disposed on the handler 31 to hold different kind of screwdriver 5 to provide service when necessary. And a fix base 6 is included in the device of the present invention to fix the device at the proper place in a car.

As to the lighting apparatus 13 of the present invention described previously, it can be incorporated with the fix base 6. A penetrating hole 131 is disposed on the case of the lighting apparatus 13 near to the power outlet and a protruding portion 61 is disposed on the corresponding place on the fix base 6 so that the protruding portion 61 can engage into the penetrating hole 131 to power off the lighting apparatus 13. When an emergency happens and the user removes the device of the present invention from the fix base 6, the protruding portion 61 will disengage from the penetrating hole 131 and the lighting apparatus 13 will be powered on and lighted on automatically.

In addition to the lighting apparatus 13, a loud-sounding alarm 14 can be installed with the device of the present invention to make loud sound when necessary to draw attention for rescue.

Although this invention has been disclosed and illustrated with reference to particular embodiments, however, the aforementioned description is just several preferable embodiments according to the invention and, of course, can not limit the range of the invention, so any equivalent variation and modification made according to the claims claimed by this invention are all still belonged to the field covered by the patent of the present invention. Please your esteemed members of reviewing committee examine the present application in clear way and grant it as a formal patent as favorably as possible.

What is claimed is:

1. A window-breaking emergency escape device comprising: a main body, a hammer and a supplementary power apparatus, the hammer and the supplementary power apparatus are installed on the main body, a front end of the hammer protrudes from a surface of the main body, the supplementary power apparatus further comprises a handler, an elastic component, a buckling component and a release button, wherein a groove is disposed on the main body for receiving the hammer, the elastic component is disposed between the hammer and the groove for providing a force to push the hammer outward, a circle rim is disposed on the hammer, and the handler is pivoted on the main body, one end of the handler extends to form an extruding portion that contacts against the rim on the hammer, when a user moves the handler, the hammer will be pushed inward to press the elastic component, the buckling component is pivoted and fixed firmly on the main body, one end of the buckling component contacts against the release button, another end of the buckling component extrudes and extends into the groove that contains the hammer, when the hammer is pushed by the extruding portion of the handler to move backward and to push the elastic components to a certain position, the hammer will be held by the buckling component.

2. The windows-breaking emergency escape device according to claim 1, wherein the main body further comprises a cutter groove that contains a cutter.

3. The windows-breaking emergency escape device according to claim 2, wherein the width of the cutter groove is smaller than that of a child's finger.

4. The windows-breaking emergency escape device according to claim 1, wherein the cutter groove is disposed in a decline manner.

5. The windows-breaking emergency escape device according to claim 1, wherein the main body further comprises a lighting apparatus.

6. The windows-breaking emergency escape device according to claim 1, wherein the handler further comprises a hole that receives a different type of screwdriver.

7. The windows-breaking emergency escape device according to claim 1, wherein the device further comprises a fix base that is placed in a proper location in a car to hold the device.

8. The windows-breaking emergency escape device according to claim 1, wherein the handler is pivoted near a protruding portion of the main body.

9. The windows-breaking emergency escape device according to claim 1, wherein the main body further comprises an alarm.

10. The windows-breaking emergency escape device according to claim 5, wherein a penetrating hole is disposed on a case of the lighting apparatus near to a power outlet and a protruding portion is disposed on the corresponding place on the fix base so that the protruding portion engages into the penetrating hole to power off the lighting apparatus.

11. The windows-breaking emergency escape device according to claim 7, wherein a penetrating hole is disposed on a case of the lighting apparatus near to a power outlet and a protruding portion is disposed on the corresponding place on the fix base so that the protruding portion engages into the penetrating hole to power off the lighting apparatus.

* * * * *